US010278459B2

(12) United States Patent
Stewart et al.

(10) Patent No.: US 10,278,459 B2
(45) Date of Patent: May 7, 2019

(54) ADJUSTABLE LOOP FOR FASHION ACCESSORIES

(71) Applicant: Two Posh Ladies, LLC, Boca Raton, FL (US)

(72) Inventors: Lesley A. Stewart, Boca Raton, FL (US); Brenda Alber, Boca Raton, FL (US)

(73) Assignee: Two Posh Ladies, LLC., Boca Raton, FL (US)

( * ) Notice: Subject to any disclaimer, the term of this patent is extended or adjusted under 35 U.S.C. 154(b) by 346 days.

(21) Appl. No.: 15/098,996

(22) Filed: Apr. 14, 2016

(65) Prior Publication Data

US 2016/0302535 A1 Oct. 20, 2016

Related U.S. Application Data

(60) Provisional application No. 62/147,472, filed on Apr. 14, 2015.

(51) Int. Cl.
*A44C 5/00* (2006.01)

(52) U.S. Cl.
CPC ..... *A44C 5/0053* (2013.01)

(58) Field of Classification Search
CPC ..... A44C 5/0053; A44C 5/0069
USPC ..... 63/1.18, 3.2; 132/273, 275
See application file for complete search history.

(56) References Cited

U.S. PATENT DOCUMENTS

| | | | | |
|---|---|---|---|---|
| 289,371 | A * | 12/1883 | Barclay | A44C 5/0092 63/11 |
| 3,099,271 | A * | 7/1963 | Dubelier | A45D 8/34 132/273 |
| 5,778,904 | A * | 7/1998 | Elsner | A45D 8/34 132/275 |
| 6,076,532 | A * | 6/2000 | Thomas | A45D 8/34 132/273 |
| 6,182,672 | B1 * | 2/2001 | Abasta-Douglas | A45D 8/00 132/273 |
| 6,276,369 | B1 * | 8/2001 | Rogers | A45D 8/36 132/273 |
| D573,055 | S * | 7/2008 | Galloway | D11/5 |
| 8,505,334 | B2 * | 8/2013 | Niikura | A44C 15/005 224/172 |
| D713,283 | S * | 9/2014 | Nghiem | D11/3 |
| D723,966 | S * | 3/2015 | Kasidi | D11/5 |
| 2014/0360228 | A1 | 12/2014 | Cochrane | |

OTHER PUBLICATIONS

The Geeky Seamstress, "Spandex 101: Basic Techniques and Finishing", Nov. 24, 2014, https://thegeekyseamstress.com/2014/11/24/spandex-101-basic-techniques-and-finishing/, pp. 1-13.

* cited by examiner

*Primary Examiner* — Abigail E Troy
(74) *Attorney, Agent, or Firm* — Fleit Gibbons Gutman Bongini Bianco PL; Jon Gibbons

(57) ABSTRACT

Method of forming an adjustable-length, stretchable, fabric cord, typically elastane-based, for use in making jewelry, eyeglass necklaces, hair bands and more. Elastane-based fabric cord is typically used in conjunction with beadwork and other jewelry components.

15 Claims, 3 Drawing Sheets

ADJUSTABLE LOOP FOR FASHION ACCESSORIES

CROSS REFERENCE TO RELATED APPLICATIONS

This application is based upon and claims priority to U.S. Provisional Patent Application Ser. No. 62/147,472, filed on Apr. 14, 2015, the disclosure of which is hereby incorporated by reference in its entirety.

BACKGROUND

The present invention relates generally to jewelry, and more specifically to fashion accessories using a flexible fabric cord.

For thousands of years men, women and children have used jewelry to adorn their bodies in various ways. Typically, although not always, an article of jewelry is used for one particular purpose such as a necklace to adorn the neck or a bracelet to adorn the wrist. These articles may or may not be embellished with beadwork or gemstones and can be made of a variety of materials. Necklaces can be long or short according to personal preference.

One popular style is a very short choker necklace. This choker-style of necklace is worn snugly around the neck. It has typically had a clip, hook or some kind of clasp attachment at the back of the neck, or has been tied at the back. By untying or unhooking the necklace, it does not have to be passed over the head, which is much larger in size. Usually the material forming the main body of a necklace or bracelet is made of some kind of chain, ribbon, cord, leather or silicone material forming a loop of material which can be used in conjunction with beadwork, clasps, pendants etc. to form the desired piece of jewelry.

Fabric materials, such as narrow strips of cotton or cotton/polyester blend, t-shirt fabric are used as a base for scarves, necklaces and bracelets. While this may look aesthetically pleasing, the lack of elasticity in the fabric strip means that it is not practical to be used as a wrap bracelet, where elasticity is helpful to get the last loop over the hand which is larger than the wrist. Cotton and cotton/polyester blended fabrics also have a tendency to fray when cut into strips and mechanically stressed. The resulting fibers which shed from the edges are undesirable in a jewelry product.

Elastic cords have often been used as a basis for stretchable jewelry, with or without additional ornamentation. Various kinds of stretchable bungee cord have also been used. Elasticity in a cord is desirable as it allows a piece of jewelry to be easily pulled over the head, hair, wrist or other body part without the need to undo a clasp. While these existing stretchable cords offer flexibility and a selection of woven patterns, they are limited in their aesthetic appeal.

SUMMARY

This present invention relates to the jewelry and accessory industry, specifically jewelry which employs the use of a flexible cord and the ability to vary the length of this cord by drawing the ends in opposite directions through a retaining structure like a bead, to enable it to be used in multiple ways, including use as an eyeglass holder with a specific attachment, such as a ring.

One aspect of the present inventions is a novel method of forming the flexible cord without the need for any sewing, gluing or other method of adhesion.

The present invention provides a jewelry cord which can be colorful and decorative in and of itself, and which has the flexibility and adjustability to be worn in a variety of ways allowing for maximum versatility. The limited selection of patterns for elastic cords, in turn limit their aesthetic appeal. With jewelry being a fashion item, it is desirable to have the option of wearing a jewelry cord in a wide range of colors, patterns and prints. This invention provides a colored or patterned cord which can then be worn as is, or adorned with additional elements.

There are other systems currently in use to lengthen and shorten a particular length of jewelry cord to offer multipurpose flexibility, using clips and clasps. The concept enables one accessory purchase to be made and the piece to be used in different ways, for example, as both a necklace and a bracelet. Our invention allows the length of the stretchable jewelry cord to be adjusted by passing the ends of the cord through a retaining structure or bead in order to form a loop. The ends are then crimped, and/or knotted, and/or beaded, or any combination thereof.

The present invention provides a jewelry cord which combines all three of the above features. First, the ability to make a cord in a particular color or print. Second, a cord with elasticity allowing it to be stretched and then regain its shape. And third, a cord of adjustable length by the simple action of pulling the ends.

In one example, the fashion strap includes a ring having one or more holes. A rectangular strip of polyurethane copolymer based material is used. The material may be elastane-based, Lycra®, spandex, or a combination thereof.

The rectangular strip is formed with two long substantially parallel side edges, a first short-edge-end with a first retainer disposed thereto, and a second short-edge-end with a second retainer disposed thereto. The rectangular strip is mechanically stretched in a direction along an axis parallel to the two long parallel side edges. This causes the two long substantially parallel side edges to curl towards each other without glue and stitching to maintain a shape of the curl.

In one example, the shape of the curl for each edge is be defined at least as a 270 degree portion of a complete 360 circular shape.

The first short-edge-end of the rectangular strip passes through the hole of the ring and the second short-edge-end of the rectangular strip passes through the hole of the ring. This creates a loop of the rectangular strip with a slidable fitting.

In one example, the first short-edge-end of the rectangular strip passes through the hole of the ring in a first direction. The second short-edge-end of the rectangular strip passing through the hole in a second direction. The second direction is opposite the first direction.

In another example, the first short-edge-end of the rectangular strip passes through the hole of the ring in a first direction. The second short-edge-end of the rectangular strip passing through the hole in a second direction. The second direction is identical to the first direction.

Each end of the rectangular strip may be knotted, include a bead, be crimped or a combination thereof to keep the end from inadvertently passing back through bead during adjustment of the length.

Holder for holding eyeglasses, keys, a whistle, or a combination thereof may be used. In addition, a holder for beads, pendants, tags, and other fashion accessories may be used.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

Described as a novel fashion accessory strap that is not only fashionable but unique, fun and comfortable to wear. Our soft fabric necklaces are available in a wide palette of fabulous colors and a selection of prints to complement every look.

One example is the charm and pendant selections reflect top fashion trends and timeless pieces that are always in style. The Tibetan silver and pewter pendants in our collection are more resistant to tarnishing than sterling silver for easy wear and care.

Another example is charm loop and pearl loop choker necklaces are fully adjustable and can be worn as a short choker, longer necklace, wrap bracelet or anklet, and a Bohemian-style headband or hairband.

Another example is pearl loops using the natural luster and the unique shapes of freshwater pearls. The contrast of pearls on our fabric chokers puts a fresh new twist on a pearl necklace. Loops can be both natural pearls and a selection of heat-set colored pearls.

Non-Limiting Terminology

The terms "a" or "an," as used herein, are defined as one or more than one.

The use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

The term "bead" as used herein, is a small piece of glass, stone, plastic, pearl, or metal that is typically rounded and perforated for threading.

The term "coupled,", as used herein, is defined as "connected" although not necessarily directly.

The term "curl" as used herein, is to form into a curved form.

The term "fashion accessory" as used herein, is a decorative item that supplements garments.

Unless stated otherwise, terms such as "first" and "second" are used to arbitrarily distinguish between the elements such terms describe. Thus, these terms are not necessarily intended to indicate temporal or other prioritization of such elements.

The term "knot" as used herein, is a fastening made by tying.

The term "polyurethane copolymer based material" means a fabric with synthetic fiber known for its exceptional elasticity.

The term "ring" as used herein, is defined as any closed band. The band may be made of natural or man-made materials including stone, wood, pearl, plastic, metal including semiprecious and precious metals, and may be adorned with one or more gemstones.

Process for Forming Fashion Accessory Strap

A loop of material is typically a polyester-polyurethane copolymer. One example is elastane, with molecular cross links that cause it to curl inwards when mechanically stressed. The mechanical stressing is typically in the form of stretching the material.

Figure 1A:
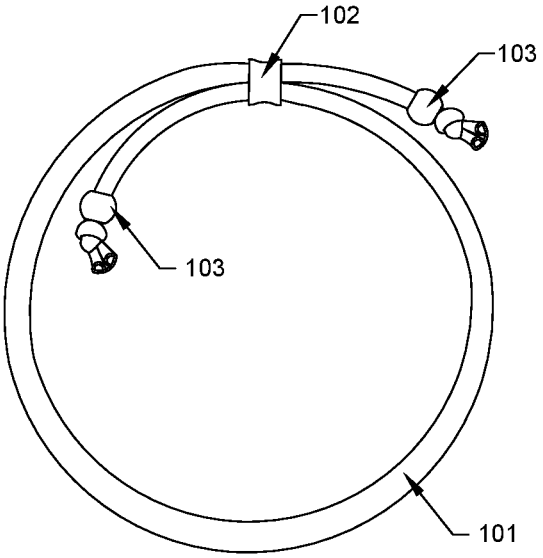
FIG. 1A is an upper perspective view of elastane-based fabric cord loop.
Figure 1B:
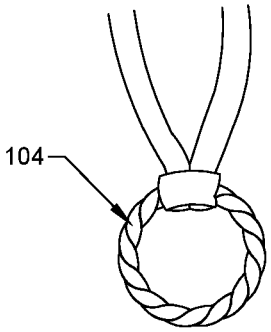
FIG. 1B is an upper perspective view of elastane-based fabric cord loop with addition of ring for use as eyeglass holder
Figure 2A:
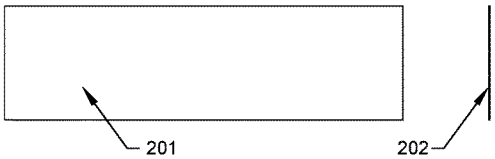
FIG. 2A is a top plan view of flat elastane fabric strip before any mechanical stressing.
Figure 2B:
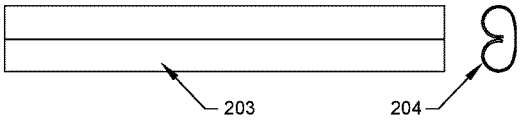
FIG. 2B is a bottom plan view of mechanically-stressed strip which has formed cord.
Figure 3:
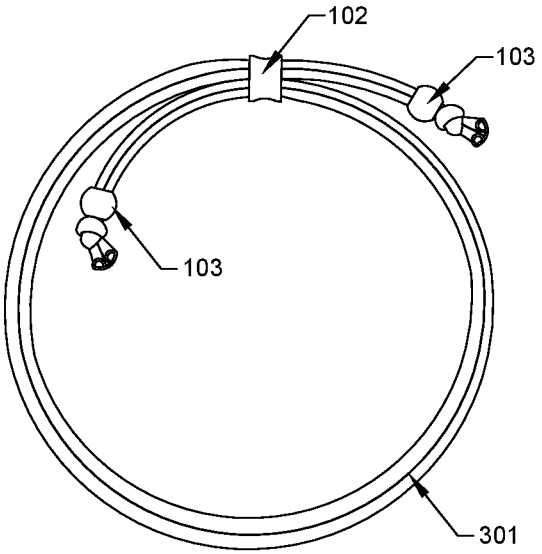
FIG. 3 is a view of elastane-based fabric cord loop.

In order to make the elastane-based fabric cord, the following steps are taken: The elastane-based fabric of selected color or print is chosen and is laid flat on a cutting table. The fabric is then cut into strips of equal width and desired length (FIG. 2A). The inventors have discovered that a ¾ inch wide piece of fabric approximately 18 inches long is a good starting point for the rectangular strip (201). 202 is a side view of rectangular strip 201. Other lengths and widths are contemplated for wearing on hair, ankle, wrists, and longer necklaces. Each strip of cut fabric is then pulled lengthwise until the edges curl inwards and the strip forms a longer cord (FIG. 2B). The curled in edges avoid the need for sewing, or other post-process operation to produce an aesthetically "finished" looking product (FIG. 1, FIG. 3). The final strip, after mechanical stretching in an axis parallel to the length of the material is approximately 3/16" wide and 20" long.

No stitching or gluing is required to maintain the shape of the cord (203). The lengths of cord are used to form the basis of jewelry and accessory items (101).

Figure 2C:
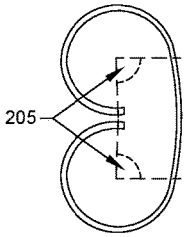
FIG. 2C is a side plan view of mechanically-stressed strip which has formed cord.

FIG. 2C is a side plan view (204, 205) of mechanically-stressed strip which has formed cord. In this example, shown is the shape of the curl defined at least as a 270 degree portion of a complete 360 circular shape.

In one example (301), in order to make an adjustable length loop of cord, the two ends of the cord are passed in opposite directions through a retaining device such as a bead with one or two holes (102).

In another example, in order to make an adjustable length loop of cord, the two ends of the cord are passed in identical directions through a retaining device such as a bead with one or two holes (102). This is a lariat-style necklace.

The cord thus forms a loop. The ends of the cord are then modified to prevent them pulling back through the retaining device. This modification is achieved by knotting the ends, and/or beading the ends, and or attaching crimp beads, or any combination thereof (103).

In one example, the loop is formed with the two ends of the cord passing through the bead, with the short-edge-end passing through the hole of the ring in a first direction and the second short-edge-end passing through the hole in a second direction, the second direction is opposite the first direction.

This size of the loop is able to be reduced by pulling on the loose ends, or enlarged by pulling on the loop itself, in order to allow movement of the extra length back and forwards through the retaining structure. This loop can be beaded in a variety of ways and depending on the length, it can be used for different purposes. For example, fully enlarged it can pass once over the head to be worn as a long necklace, and then passed a second time over a wearer's head, made possible by the elasticity of the cord, to form a doubled shorter necklace. Alternatively, this same piece can be worn as a wrap bracelet by winding it around the wrist several times. It can then be adjusted for a good fit, by pulling on the loose ends to make a final size adjustment. This can be done by gripping one loose end between the forefinger and thumb of the hand next to the bracelet, and taking the other loose end with the free hand, and pulling to reach desired fit. In the same way, this cord can be used to make a choker necklace or small bracelet or anklet, a headband, a hairband or accessory around other body parts. It may also be worn as an adjustable belt.

An advantage of this invention is the simplicity and ease by which the items can be worn. For larger ladies the ability to enlarge the size of the loop is very practical, and older people find the ease of adjusting the size without needing to fuss with a clip or clasp a huge benefit. It is also an easy accessory for a person who has physical limitations to wear as the stretch of the cord facilitates its use and avoids a feeling of restriction when worn as a necklace or choker.

A further embodiment of the invention is an eyeglass retainer. By attaching a ring to the front lower portion of the loop of cord, (104) the leg of a pair of eyeglasses can be passed through the ring, and the eyeglasses can be suspended like a pendant. Due to the elasticity of the fabric cord, this eyeglass necklace is very easy to slip over the head and can be adjusted in length by pulling the loose ends of the loop behind the neck. Unlike other eyeglass necklaces on the market, the cord being made of stretchable fabric is able to look very stylish as it can be made in a wide variety of patterns, prints and solid colors. This makes it aesthetically pleasing even when it is not being used to hold eyeglasses, as it can visually appear as a necklace.

Non-Limiting Examples

Although the invention is described herein with reference to specific examples, various modifications and changes can be made without departing from the scope of the present invention as set forth in the claims below.

What is claimed is:

1. A fashion accessory strap comprising:

a ring having at least one hole; and a single permanently stretched rectangular strip formed by a rectangular strip of polyurethane copolymer based material, the rectangular strip formed with two long substantially parallel side edges, and the single permanently stretched rectangular strip having been mechanically stretched in a direction along an axis parallel to the two long substantially parallel side edges, thereby causing the two long substantially parallel side edges to curl towards each other without glue and stitching to maintain a shape of a curl, the single permanently stretched rectangular strip with a first short-edge-end with a first retainer disposed thereto, a second short-edge-end with a second retainer disposed thereto, wherein the first retainer is a first bead and the second retainer is a second bead, and the first short-edge-end passing through the at least one hole of the ring and the second short-edge-end passing through the at least one hole of the ring to create a loop of the single permanently stretched rectangular strip with a slidable fitting, wherein the first short-edge-end passes through the at least one hole of the ring in a first direction and the second short-edge-end passes through the at least one hole in a second direction, the second direction is opposite the first direction.

2. The fashion accessory strap of claim 1, wherein the rectangular strip of polyurethane copolymer based material is elastane material.

3. The fashion accessory strap of claim 1, wherein the rectangular strip of polyurethane copolymer based material is Lycra® material.

4. The fashion accessory strap of claim 1, wherein the rectangular strip of polyurethane copolymer based material is spandex material.

5. The fashion accessory strap of claim 1, further comprising the ring having at least a first hole and a second hole, and the first short-edge-end passing through the first hole and the second short-edge-end passing through the second hole.

6. The fashion accessory strap of claim 1, further comprising:

a second ring having at least one hole with the single permanently stretched rectangular strip passing therethrough.

7. The fashion accessory strap of claim 1, further comprising:

a first knot disposed with the first retainer and a second knot disposed with the second retainer.

8. The fashion accessory strap of claim 1, wherein the single permanently stretched rectangular strip is more than 10 percent longer than the rectangular strip before it was mechanically stretched.

9. A fashion accessory strap comprising:

a ring having at least one hole;

a single permanently stretched rectangular strip formed by a rectangular strip of polyurethane copolymer based material, the rectangular strip formed with two long substantially parallel side edges, and the single permanently stretched rectangular strip having been mechanically stretched in a direction along an axis parallel to the two long substantially parallel side edges, thereby causing the two long substantially parallel side edges to curl towards each other without glue and stitching to maintain a shape of a curl, and the shape of the curl defined by forming at least 270 degree portion of a complete 360 degree circular shape, the single permanently stretched rectangular strip with a first short-edge-end with a first bead acting as a first retainer disposed thereto, and a second short-edge-end with a second bead acting as a second retainer disposed thereto, wherein the first short-edge-end passes through the at least one hole of the ring in a first direction and the second short-edge-end passes through the at least one hole in a second direction, the second direction is opposite the first direction to create a loop of the rectangular strip with a slidable fitting.

10. The fashion accessory strap of claim 9, wherein the rectangular strip of polyurethane copolymer based material is elastane material.

11. The fashion accessory strap of claim 9, wherein the rectangular strip of polyurethane copolymer based material is Lycra® material.

12. The fashion accessory strap of claim 9, wherein the rectangular strip of polyurethane copolymer based material is spandex material.

13. The fashion accessory strap of claim 9, further comprising:

a ring having at least one hole with the single permanently stretched rectangular strip passing therethrough.

14. The fashion accessory strap of claim 9, further comprising:

a first knot disposed with the first retainer and a second knot disposed with the second retainer.

15. The fashion accessory strap of claim 9, wherein the single permanently stretched rectangular strip is more than 10 percent longer than the rectangular strip before it was mechanically stretched.

* * * * *